US008323743B2

(12) United States Patent
Nakayama et al.

(10) Patent No.: US 8,323,743 B2
(45) Date of Patent: Dec. 4, 2012

(54) ACRYLIC-FIBER FINISH, ACRYLIC FIBER FOR CARBON-FIBER PRODUCTION, AND CARBON-FIBER PRODUCTION METHOD

(75) Inventors: Takeyoshi Nakayama, Yao (JP); Yoshio Hashimoto, Yao (JP); Mikio Nakagawa, Yao (JP)

(73) Assignee: Matsumoto Yushi-Seiyaku Co., Ltd., Yao-Shi (JP)

( * ) Notice: Subject to any disclaimer, the term of this patent is extended or adjusted under 35 U.S.C. 154(b) by 0 days.

(21) Appl. No.: 13/262,890

(22) PCT Filed: May 21, 2010

(86) PCT No.: PCT/JP2010/058582

§ 371 (c)(1),
(2), (4) Date: Oct. 4, 2011

(87) PCT Pub. No.: WO2010/140488

PCT Pub. Date: Dec. 9, 2010

(65) Prior Publication Data

US 2012/0021125 A1 Jan. 26, 2012

(30) Foreign Application Priority Data

Jun. 4, 2009 (JP) ..... 2009-134740

(51) Int. Cl.

| | |
|---|---|
| ***B05D 3/02*** | (2006.01) |
| ***H01L 23/29*** | (2006.01) |
| ***C08K 3/20*** | (2006.01) |
| ***D02G 3/00*** | (2006.01) |

(52) U.S. Cl. ..... 427/377; 423/425; 423/435; 428/378

(58) Field of Classification Search ..... 427/377; 523/435, 425; 428/378
See application file for complete search history.

(56) References Cited

U.S. PATENT DOCUMENTS

| | | | | |
|---|---|---|---|---|
| 6,103,211 | A * | 8/2000 | Matsuhisa et al. | 423/447.8 |
| 2003/0216278 | A1 * | 11/2003 | Depoot et al. | 510/421 |
| 2008/0152574 | A1 | 6/2008 | Tanaka et al. | |
| 2009/0263576 | A1 | 10/2009 | Okabe et al. | |
| 2010/0247911 | A1 | 9/2010 | Aso et al. | |

FOREIGN PATENT DOCUMENTS

| | | | | |
|---|---|---|---|---|
| CN | 1982356 | A | | 6/2007 |
| JP | S60-181322 | A | | 9/1985 |
| JP | 10280261 | A | * | 10/1998 |
| JP | 2001-172879 | A | | 6/2001 |
| JP | 2002-371477 | A | | 12/2002 |
| JP | 2004-197272 | A | | 7/2004 |
| JP | 2007-039866 | A | | 2/2007 |
| JP | 2008-202208 | A | | 9/2008 |
| WO | WO 2006058273 | A2 | * | 6/2006 |
| WO | WO2007/066517 | A1 | | 6/2007 |
| WO | WO2009/060834 | A1 | | 5/2009 |

OTHER PUBLICATIONS

Chinese Office Action of the corresponding Chinese Application No. 201080024414.8, dated Sep. 29, 2012.

* cited by examiner

*Primary Examiner* — Nathan Empie
(74) *Attorney, Agent, or Firm* — Global IP Counselors, LLP

(57) ABSTRACT

An acrylic-fiber finish for use in carbon-fiber production contributes to high tenacity of resultant carbon fiber. The acrylic-fiber finish for carbon-fiber production includes an epoxy-polyether-modified silicone and a surfactant. The weight ratios of the epoxy-polyether-modified silicone and the surfactant in the total of the non-volatile components of the finish respectively range from 1 to 95 wt % and from 5 to 50 wt %. The carbon fiber production method includes a fiber production process for producing an acrylic fiber for carbon-fiber production by applying the finish to an acrylic fiber which is a basic material for the acrylic fiber for carbon-fiber production; an oxidative stabilization process for converting the acrylic fiber produced in the fiber production process into oxidized fiber in an oxidative atmosphere at 200 to 300 deg.C.; and a carbonization process for carbonizing the oxidized fiber in an inert atmosphere at 300 to 2,000 deg.C.

15 Claims, No Drawings

ACRYLIC-FIBER FINISH, ACRYLIC FIBER FOR CARBON-FIBER PRODUCTION, AND CARBON-FIBER PRODUCTION METHOD

TECHNICAL FIELD

The present invention relates to an acrylic-fiber finish for carbon-fiber production, acrylic fiber for carbon-fiber production, and carbon-fiber production method aiming to provide high-tenacity carbon fiber. Specifically, the present invention relates to an acrylic-fiber finish for carbon-fiber production (hereinafter sometimes referred to as a precursor finish), which is used in producing an acrylic fiber for carbon-fiber production (hereinafter sometimes referred to as precursor) to attain high fiber tenacity, an acrylic fiber for carbon-fiber production applied with the finish, and a carbon-fiber production method which employs the finish.

TECHNICAL BACKGROUND

Carbon fiber is employed as a fiber for reinforcing a composite material comprising a plastic usually called matrix resin owing to its excellent mechanical property, and is applied widely in various end uses including aerospace industry, sports goods industry, and other general industries.

A common method for manufacturing carbon fiber involves a process of producing precursor (also referred to as fiber production process), a process of converting the precursor into an oxidized fiber in an oxidative atmosphere at 200 to 300 deg. C. (hereinafter sometimes referred to as oxidative stabilization process), and a process of carbonizing the oxidized fiber in an inert atmosphere at 300 to 2,000 deg. C. (hereinafter sometimes referred to as carbonizing process). The oxidative stabilization and carbonizing processes are hereinafter sometimes collectively referred to as baking process. The process of producing precursor includes a drawing step where acrylic fiber is drawn with a draw ratio higher than that for an ordinary acrylic fiber. At the drawing step, acrylic fiber is apt to adhere to adjacent fiber strands, drawn unevenly under high draw ratio, and processed into nonuniform precursor. Such nonuniform precursor poses a problem, i.e., insufficient tenacity of resultant carbon fiber which is produced by baking the precursor. The baking process also poses another problem, i.e., fusing of single precursor fibers, which reduces the quality and grade of resultant carbon fiber.

For preventing the adhesion of single precursor fibers and the fusion of carbon fiber, a number of techniques to apply finishes to precursors have been suggested (refer to Patent References 1 and 2) and widely employed in industries, in which silicone finishes attaining low fiber-to-fiber wet friction at high temperature and excellent fiber detaching property, especially finishes comprising amino-modified silicones which cross-link on fiber to improve the heat resistance of the fiber, are used. Those silicone finishes, however, sometimes failed to produce carbon fiber having sufficient tenacity.

REFERENCE OF PRIOR ART

Patent Reference

[Patent Reference 1] JP A 60-181322
[Patent Reference 2] JP A 2001-172879

DISCLOSURE OF INVENTION

Technical Problem

Based on the conventional technology and background, the present invention aims to provide an acrylic-fiber finish for carbon-fiber production, acrylic fiber for carbon-fiber production, and carbon-fiber production method which provide high-tenacity carbon fiber.

Technical Solution

Silicone finishes are usually dispersed in water to be made into emulsion for the purpose of applying them to precursors uniformly and safely in industrial processes. For silicone finishes with poor self-emulsification property, various surfactants are added to the finishes as an emulsifier to make those finishes into emulsion.

The inventors of the present invention have diligently worked to solve the problem mentioned above, and found that those emulsifiers often become incompatible with the silicone components after the finish emulsions are dehydrated and completely dried. The inventors also found that such silicone components and emulsifiers separate on precursor surface and result in nonuniform coating on precursor surface, after a silicone finish emulsion containing those silicone components and emulsifiers is applied to precursor and dried. The inventors further found that the nonuniform coating is one of the causes of unevenly heated precursor in baking process where precursor is converted into carbon fiber, and is also the cause of insufficient tenacity of resultant carbon fiber.

The inventors also found that silicone components attaining low wet fiber-to-fiber friction at high temperature and imparting excellent detaching property to precursor fiber sometimes lead to poor cohesion of precursor fiber bundles, which is apt to cause separation of single fibers and subsequently cause broken fibers in precursor fiber production and baking processes so as to result in insufficient tenacity of carbon fiber after the baking process.

The inventors have achieved the present invention as the result of the finding that an acrylic-fiber finish for carbon-fiber production containing a specific modified silicone and surfactant as essential components is able to improve the uniformity of absolutely dried finish film and the cohesion of precursor fiber bundles so as to solve the problem mentioned above.

The present invention provides an acrylic-fiber finish for carbon-fiber production containing an epoxy-polyether-modified silicone and surfactant as essential components, in which the weight ratio of the epoxy-polyether-modified silicone ranges from 1 to 95 wt % and the weight ratio of the surfactant ranges from 5 to 50 wt % in the non-volatile components of the finish.

The epoxy-polyether-modified silicone should preferably be a modified dimethyl polysiloxane modified by a substituent group containing both of a (poly)oxyalkylene group and epoxy group, or a modified dimethyl polysiloxane modified by two different substituent groups that are a substituent group containing an epoxy group and a substituent group containing a (poly)oxyalkylene group.

The epoxy-polyether-modified silicone should preferably be at least one compound selected from the compounds represented by the following chemical formulae (1) and (2).

[Chemical formula 1]

(1)

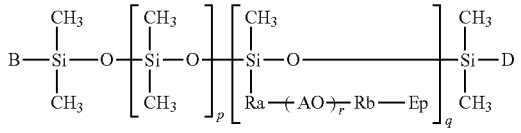

-continued

[Chemical formula 2]

(2)

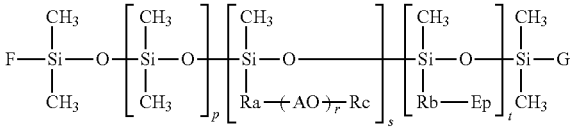

Each of the symbols in the formulae (1) and (2) independently represents the meaning as follows.

Ep: an epoxy group represented by the chemical formula (3) or (4) shown below

A: a $C_2$-$C_4$ alkylene group, where each "A" of $(AO)_r$ may be the same or different Ra: a $C_1$-$C_6$ alkylene group Rb: a $C_1$-$C_6$ alkylene group or an alkoxyalkylene group represented by —$R^1OR^2$— (where $R^1$ and $R^2$ represent $C_1$-$C_6$ alkylene groups, which may be the same or different)

Rc: a hydrogen atom or a $C_1$-$C_{10}$ alkyl group r: an integer ranging from 1 to 50 p: an integer ranging from 1 to 10,000 q: an integer ranging from 1 to 100 s: an integer ranging from 1 to 100 t: an integer ranging from 1 to 100

B, D: a $C_1$-$C_3$ alkyl group, $C_1$-$C_3$ alkoxy group, hydroxyl group, or —Ra-$(AO)_r$—Rb-Ep, where B and D may be the same or different F, G: a $C_1$-$C_3$ alkyl group, $C_1$-$C_3$ alkoxy group, hydroxyl group, —Rb-Ep, or —Ra-$(AO)_r$—Rc, where F and G may be the same or different

[Chemical formula 3]

(3)

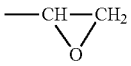

[Chemical formula 4]

(4)

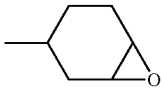

The epoxy group of the epoxy-polyether-modified silicone is preferably a glycidyl epoxy group.

The finish of the present invention may further contain an amino-modified silicone. The total weight ratio of the epoxy-polyether-modified silicone and the amino-modified silicone should range from 30 to 95 wt % in the non-volatile components of the finish, and the weight ratio between the epoxy-polyether-modified silicone and the amino-modified silicone should range from 5:95 to 90:10.

The acrylic-fiber finish for carbon-fiber production of the present invention should preferably be an aqueous emulsion.

The acrylic fiber (precursor) for carbon-fiber production of the present invention is produced by applying the acrylic-fiber finish for carbon-fiber production to acrylic fiber which is the basic material of acrylic fiber for carbon-fiber production.

The carbon-fiber production method of the present invention involves a fiber production process where acrylic fiber (precursor) for carbon-fiber production is produced by applying an acrylic-fiber finish (precursor finish) for carbon-fiber production to acrylic fiber which is the basic material of acrylic fiber for carbon-fiber production; oxidative stabilization process where the precursor produced in the fiber production process is oxidized in an oxidative atmosphere at 200 to 300 deg.C.; and carbonizing process where the oxidized precursor is carbonized in an inert atmosphere at 300 to 2,000 deg.C.

Advantageous Effects

The acrylic-fiber finish for carbon-fiber production of the present invention is applied to acrylic fiber which is the basic material of acrylic fiber for carbon-fiber production in order to produce uniformly drawn acrylic fiber for carbon-fiber production with minimum fiber separation and minimal broken fiber. The finish prevents uneven heating of precursor in baking processes including oxidizing and carbonizing processes in carbon-fiber production so as to improve the tenacity of carbon fiber. The carbon-fiber production method of the present invention enables the production of high-tenacity carbon fiber owing to the acrylic-fiber finish for carbon-fiber production applied to precursor.

BEST MODE FOR CARRYING OUT THE INVENTION

The primary aim of the acrylic-fiber finish for carbon-fiber production (precursor finish) of the present invention is its application to acrylic fiber, which is the basic material of carbon fiber precursor, before the drawing step in the production process of acrylic fiber for carbon-fiber production (precursor). The finish essentially comprises an epoxy-polyether-modified silicone and surfactant, and the weight ratios of the epoxy-polyether-modified silicone and surfactant respectively range from 1 to 95 wt % and from 5 to 50 wt % in the total amount of the non-volatile components of the finish. The finish is described below in detail.

[Epoxy-Polyether-Modified Silicone]

The precursor finish of the present invention contains an epoxy-polyether-modified silicone as an essential component. The epoxy-polyether-modified silicone is not specifically restricted so far as it is a modified dimethyl polysiloxane modified by a substituent group having an epoxy group in its molecular structure and a substituent group having a (poly)oxyalkylene group in its molecular structure. Specifically, the epoxy-polyether-modified silicone includes a modified dimethyl polysiloxane being modified by a substituent group containing both of a (poly)oxyalkylene group and epoxy group, and a modified dimethyl polysiloxane being modified by two different substituent groups one of which contains epoxy group and the other contains a (poly)oxyalkylene group. More specifically, the epoxy-polyether-modified silicone includes a modified dimethyl polysiloxane having methyl groups some of which are each substituted with a substituent group containing both of an epoxy group and (poly)oxyalkylene group, and a modified dimethyl polysiloxane having methyl groups some of which are each substituted with a substituent group containing an epoxy group and some other of which are each substituted with a substituent group containing a (poly)oxyalkylene group. A substituent group bonded to the terminal silicon of the modified dimethyl polysiloxane, except other two methyl groups bonded to the silicon, may be a $C_1$-$C_3$ alkyl group, i.e., methyl, ethyl or propyl group; a $C_2$-$C_3$ alkoxy group, i.e., methoxy, ethoxy or propoxy group; a hydroxyl group; or a substituent group similar to that substituting a methyl group of the principal chain of the dimethyl polysiloxane, i.e., a substituent group having an epoxy group, a (poly)oxyalkylene group or both of an epoxy group and (poly)oxyalkylene group. The epoxy-polyether-modified silicone is further described below in detail.

The epoxy-polyether-modified silicone includes the compounds represented by the chemical formulae (1) and (2) illustrated above. The symbol, "Ep", in the formulae represents a glycidyl epoxy group having a structure represented by the chemical formula (3), or an alicyclic epoxy group having a structure represented by the chemical formula (4). Either of the epoxy groups is employable and not specifically restricted, though the glycidyl epoxy group is preferable for its versatile structure to be easily synthesized into various compounds.

The (poly)oxyalkylene group of the epoxy-polyether-modified silicone is not specifically restricted, and should preferably be a (poly)oxyalkylene group having 1 to 50 repeating units of oxyalkylene group and forming a side chain bonded to the principal chain containing 1 to 100 repeating silicon atoms, for the affinity of the epoxy-polyether-modified silicone to emulsifiers and to other silicone components if they are used in combination. For example, the (poly)oxyalkylene group of the compound represented by the chemical formula (1) should preferably have oxyalkylene repeating units in a number represented by "r" ranging from 1 to 50 and form a side chain bonded to the principal chain having repeating silicon atoms in a number represented by "q" ranging from 1 to 100. More preferably, the numbers represented by "r" and "q" should respectively range from 1 to 30 and from 10 to 80, and further more preferably from 5 to 20 and from 15 to 60. For the compound represented by the chemical formula (2) illustrated above, the ratio between the number of repeating silicone atoms, "s", in the principal chain to which a substituent group containing a (poly)oxyalkylene group is bonded, and the number of repeating silicone atoms, "t", in the principal chain to which a substituent group containing a epoxy group is bonded is not specifically restricted, though the numbers for "s" and "t" should preferably be similar to each other in order to settle the hydrophilic-lipophilic balance of the compound preferable for better compatibility of the compound to emulsifiers. In other words, it is preferable that "r", "s" and "t" in the chemical formula (2) respectively range from 5 to 20, from 15 to 60, and from 1 to 100; more preferable that they respectively range from 5 to 20, from 15 to 60, and from 10 to 80; and further more preferable that they respectively range from 5 to 20, from 15 to 60, and from 15 to 60.

In compound represented by the chemical formula (1), the symbol "A" of $(AO)_r$ represents a $C_2$-$C_4$ alkylene group and all of "A" may be the same or different. In other words, the oxyalkylene group represented by (AO) includes oxyethylene group, oxypropylene group and oxybutylene group, and the oxyalkylene groups constituting the polyoxyalkylene group may be the same or different as exemplified by block or random copolymers of oxyethylene and oxypropylene groups. Of such polyoxyalkylene groups, random copolymers of oxyethylene and oxypropylene groups and random copolymers of oxyethylene and oxybutylene groups are preferable for their good emulsifiability in water, good compatibility with emulsifiers to contribute to uniform finish film formation, good handling property, and easily controllable hydrophilic-lipophilic balance and viscosity. If improved finish film uniformity, one of the major factors of the present invention, is emphasized, random copolymers of oxyethylene and oxypropylene groups, or (poly)oxyethylene group is preferable.

The symbol "Ra" represents a $C_1$-$C_6$ alkylene group, and preferably a $C_1$-$C_3$ alkylene group. The symbol "Rb" represents a $C_1$-$C_6$ alkylene group or an alkoxyalkylene group represented by —$R^1OR^2$— (wherein each of $R^1$ and $R^2$ represents a $C_1$-$C_6$ alkylene group, which may be the same or different). For the $C_1$-$C_6$ alkylene group, the carbon number should preferably range from 1 to 4. For the alkoxyalkylene group, the carbon numbers of $R^1$ and $R^2$ should preferably range from 1 to 3. The symbol "r" represents an integer ranging from 1 to 50, preferably from 1 to 30, more preferably from 5 to 25, and further more preferably from 5 to 20. The symbol "p" represents an integer ranging from 1 to 10,000, preferably from 100 to 1,000, more preferably from 200 to 800, and further more preferably from 300 to 700. The symbol "q" represents an integer ranging from 1 to 100, preferably from 10 to 80, and more preferably from 15 to 60.

The symbols "B" and "D" respectively represent a $C_1$-$C_3$ alkyl group, $C_1$-$C_3$ alkoxy group, hydroxyl group, or —Ra-$(AO)_r$—Rb-Ep, and "B" and "D" may be the same or different. For giving the priority to the cross-linking performance of the modified silicone, "B" and "D" should preferably be —Ra-$(AO)_r$—Rb-Ep, and more preferably be a hydroxyl group. If the priority is given to "the inhibition of finish gumming up at finish-application step", i.e., "good processability of precursor and efficient precursor production", and to the stability of a precursor finish, "B" and "D" should preferably be a $C_1$-$C_3$ alkyl group or $C_1$-$C_3$ alkoxy group, more preferably a $C_1$-$C_3$ alkyl group, and further more preferably a methyl or ethyl group for easy finish formulation in addition to those given the priority.

In the chemical compound represented by the formula (2), the symbols "A", "Ra", "Rb", "r" and "p" are the same as those in the chemical formula (1). The symbol "Rc" represents a hydrogen atom or $C_1$-$C_{10}$ alkyl group. "Rc" should preferably be a hydrogen atom or $C_1$-$C_3$ alkyl group, and more preferably a hydrogen atom. The symbols "s" and "t" represent integers ranging from 1 to 100, preferably from 10 to 80 and more preferably from 15 to 60.

The symbols "F" and "G" each represent a $C_1$-$C_3$ alkyl group, $C_1$-$C_3$ alkoxy group, hydroxyl group, —Rb-Ep, or —Ra-$(AO)_r$—Rc, and "F" and "G" may be the same or different. For giving the priority to the cross-linking performance of the modified silicone, "F" and "G" should preferably be a hydroxyl group, —Rb-Ep or —Ra-$(AO)_r$—Rc, more preferably a hydroxyl group or —Rb-Ep, and further more preferably a hydroxyl group. If the priority is given to "the inhibition of finish gumming up at finish-application step", i.e., "good processability of precursor and efficient precursor production" and to the stability of a precursor finish, "F" and "G" should preferably be a $C_1$-$C_3$ alkyl group or $C_1$-$C_8$ alkoxy group, more preferably be a $C_1$-$C_3$ alkyl group, and further more preferably a methyl or ethyl group, for easy finish formulation in addition to those given the priority.

The epoxy-polyether-modified silicone represented by the chemical formula (1) or (2) can be synthesized in a known process from a methyl hydrogen polysiloxane which is formed by substituting some of methyl groups of a dimethyl polysiloxane with hydrogen atoms and from an organic compound having an unsaturated terminal bond. In other words, the epoxy-polyether-modified silicone can be synthesized in the hydrosilylation of a methyl hydrogen polysiloxane. The organic compound having an unsaturated terminal bond includes the compounds represented by the chemical formulae (5) to (15), and is not restricted within the scope of those compounds.

In the chemical formulae (5) to (15), the symbols "x" and "y" respectively represent an integer at least 0 and satisfy the expression, $r-1 \geqq x+y \geqq 1$. The compound represented by the chemical formulae (5) to (15) may be either a single compound or a mixture of compounds selected from those defined by the possible combination of "x" and "y".

[Chemical formula 5]

(5)

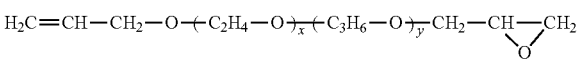

The modified polysiloxane represented by the chemical formula (1), in which each of "Ra" and "Rb" is a methylene group, "Ep" is an epoxy group represented by the chemical formula (3), $(AO)_r$ is an oxyethylene-oxypropylene copolymer, (poly)oxyethylene group or oxyethylene-(poly)oxypropylene group, and r=x+y+1, is synthesized in the hydrosilylation.

[Chemical formula 6]

(6)

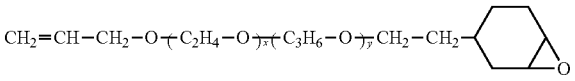

The modified polysiloxane represented by the chemical formula (1), in which "Ra" is a methylene group, "Rb" is an ethylene group, "Ep" is an epoxy group represented by the chemical formula (4), $(AO)_r$ is an oxyethylene-oxypropylene copolymer, (poly)oxyethylene group or oxyethylene-(poly)oxypropylene group, and r=x+y+1, is synthesized in the hydrosilylation.

[Chemical formula 7]

(7)

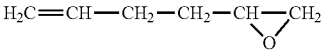

The modified polysiloxane represented by the chemical formula (2), in which "Rb" is a $C_4$ alkylene group and "Ep" is an epoxy group represented by the chemical formula (3), is synthesized in the hydrosilylation.

[Chemical formula 8]

(8)

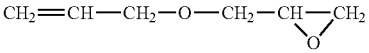

The modified polysiloxane represented by the chemical formula (2), in which "Rb" is an alkoxyalkylene group represented by $—R^1OR^2—$ wherein $R^1$ is a propylene group and $R^2$ is a methylene group, is synthesized in the hydrosilylation.

[Chemical formula 9]

(9)

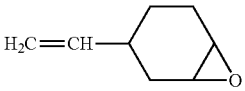

The modified polysiloxane represented by the chemical formula (2), in which "Rb" is an ethylene group and Ep is an epoxy group represented by the chemical formula (4), is synthesized in the hydrosilylation.

[Chemical formula 10]

$$H_2C{=}CH—CH_2—CH_2—OH \quad (10)$$

The modified polysiloxane represented by the chemical formula (2), in which "Ra" is an ethylene group, AO is an oxyethylene, r=1, and Rc is an hydrogen atom, is synthesized in the hydrosilylation.

[Chemical formula 11]

(11)

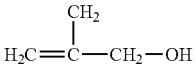

The modified polysiloxane represented by the chemical formula (2), in which "Ra" is a methylene group, AO is an oxypropylene, r=1, and Rc is an hydrogen atom, is synthesized in the hydrosilylation.

[Chemical formula 12]

$$CH_2{=}CH—CH_2—O—(C_2H_4—O)_x(C_3H_6—O)_y—H \quad (12)$$

The modified polysiloxane represented by the chemical formula (2), in which "Ra" is a methylene group, Rc is an hydrogen atom, $(AO)_r$ is an oxyethylene-oxypropylene copolymer, (poly)oxyethylene group or oxyethylene-(poly)oxypropylene group, and r=x+y+1, is synthesized in the hydrosilylation.

[Chemical formula 13]

$$CH_2{=}CH—CH_2—O—(C_2H_4—O)_x(C_3H_6—O)_y—CH_3 \quad (13)$$

The modified polysiloxane represented by the chemical formula (2), in which "Ra" is a methylene group, Rc is a methyl group, (AO), is an oxyethylene-oxypropylene copolymer, (poly)oxyethylene group or oxyethylene-(poly)oxypropylene group, and r=x+y+1, is synthesized in the hydrosilylation.

[Chemical formula 14]

(14)

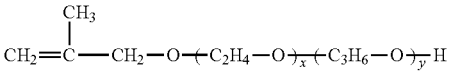

The modified polysiloxane represented by the chemical formula (2), in which "Ra" is a methylene group, Rc is a hydrogen atom, $(AO)_r$ is an oxyethylene-oxypropylene copolymer, oxypropylene-(poly)oxyethylene group or (poly) oxypropylene group, and r=x+y+1, is synthesized in the hydrosilylation.

[Chemical formula 15]

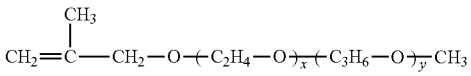

(15)

The modified polysiloxane represented by the chemical formula (2), in which "Ra" is a methylene group, Rc is a methyl group, $(AO)_r$ is an oxyethylene-oxypropylene copolymer, oxypropylene-(poly)oxyethylene group or (poly)oxypropylene group, and r=x+y+1, is synthesized in the hydrosilylation.

The examples of the compound represented by the chemical formula (1) include a modified polysiloxane synthesized in the hydrosilylation of methyl hydrogen polysiloxane and at least one compound selected from those represented by the chemical formulae (5) and (6).

The examples of the compound represented by the chemical formula (2) include a modified polysiloxane synthesized in the hydrosilylation of methyl hydrogen polysiloxane, at least one compound (epoxy-group-containing compound) selected from those represented by the chemical formulae (7), (8) and (9), and at least one compound (polyoxyalkylene-group-containing compound) selected from those represented by the chemical formulae (10) to (15).

The epoxy-polyether-modified silicone contains a (poly) oxyalkylene group in its molecule and is readily emulsified into stable aqueous emulsion. The silicone attains low fiber-to-fiber wet friction at high temperature, and sufficiently prevents fiber from adhesion at drawing step. The silicone is compatible to emulsifiers and easily forms uniform film. In addition, the epoxy-polyether-modified silicone has excellent heat resistance, thus forms heat-resistant uniform film which is advantageous to prevent fiber fusing in baking process.

The epoxy-polyether-modified silicone attains higher fiber-to-fiber friction than that by an amino-modified silicone and is advantageous to improve the cohesion of precursor fiber bundles. Thus the epoxy-polyether-modified silicone enables feeding of uniform precursor bundles with minimum looseness to baking process and contributes to high-tenacity carbon fiber production. The epoxy-polyether-modified silicone is less apt to gum up than an amino-modified silicone and attains better fiber production efficiency.

As described below, a combination of an epoxy-polyether-modified silicone and amino-modified silicone may be used as the silicone component. The amino-modified silicone has better thermal cross-linking performance than the epoxy-polyether-modified silicone and exhibits better heat resistance. In addition, the amino-modified silicone attains lower fiber-to-fiber wet friction at high temperature. Therefore, the combination of the epoxy-polyether-modified silicone and amino-modified silicone is more advantageous for preventing fiber adhesion at drawing step and fiber fusing in baking process. A finish containing the combination more readily forms uniform finish film and is less apt to gum up than a finish containing an amino-modified silicone alone as the silicone component. Thus the finish attains excellent fiber production efficiency and cohesion of precursor bundles.

A finish containing an epoxy-modified silicone as the silicone component does not readily form uniform film because the epoxy-modified silicone is not easily made into a stable aqueous emulsion and has poor compatibility with emulsifiers. A combination of an epoxy-modified silicone and amino-modified silicone also is not easily made into a stable aqueous emulsion. In addition, the combination does not readily form uniform film, and it is difficult to produce high-tenacity carbon fiber with such silicone component.

A finish containing a polyether-modified silicone as the silicone component has poor heat resistance and fails to sufficiently prevent fiber adhesion under high temperature wet condition at drawing step and fiber fusing in baking process. Thus such finish cannot produce high-tenacity carbon fiber. A combination of a polyether-modified silicone and amino-modified silicone cannot simultaneously attain good heat resistance and minimum gumming up.

A finish containing a combination of an epoxy-modified silicone and polyether-modified silicone also is not easily made into stable aqueous emulsion nor formed into uniform film. Further, such finish has poor heat resistance to fail to sufficiently prevent fiber fusion in baking process, and fail to produce high-tenacity carbon fiber.

A finish containing a combination of an epoxy-modified silicone, polyether-modified silicone and amino-modified silicone also is not easily made into stable aqueous emulsion nor formed into uniform film, thus such finish fails to produce high-tenacity carbon fiber.

The viscosity of the epoxy-polyether-modified silicone at 25 deg.C. is not specifically restricted, and should preferably range from 100 to 15,000 $mm^2/s$, more preferably from 300 to 10,000 $mm^2/s$, and further more preferably from 500 to 5,000 $mm^2/s$ for preventing finish scattering in each process after finish application and for good handling property.

The amount of epoxy groups contained in the epoxy-polyether-modified silicone is not specifically restricted, and should preferably range from 500 to 15,000 g/mol in the equivalent amount for the modification, more preferably from 500 to 5,000 g/mol, and further more preferably from 500 to 3,000 g/mol, because an epoxy-polyether-modified silicone containing excessive amount of epoxy groups is poorly emulsifiable in an aqueous medium, and an epoxy-polyether-modified silicone containing insufficient amount of epoxy groups results in extremely short shelf life of resultant finishes due to the proneness of epoxy rings to cyclize in an aqueous medium that remarkably shortens the remaining period of the epoxy rings in the silicone.

The preferable examples of the compound represented by the chemical formula (1) mentioned above include an epoxy-polyether-modified silicone synthesized in the hydrosilylation of a methyl hydrogen polysiloxane and a compound represented by the chemical formula (5), which has a viscosity of 2,000 $mm^2/s$ at 25 deg.C. and an epoxy equivalent of 3,000 g/mol (and is a mixture of epoxy-polyether-modified silicones wherein a substituent for a terminal silicon is a trimethyl group, r ranges from 1 to 20, p ranges from 10 to 1,000 and q ranges from 10 to 80); and an epoxy-polyether-modified silicone synthesized in the hydrosilylation of a methyl hydrogen polysiloxane and a compound represented by the chemical formula (6), which has a viscosity of 4,000 $mm^2/s$ at 25 deg.C. and an epoxy equivalent of 2,800 g/mol (and is a mixture of epoxy-polyether-modified silicones wherein a substituent for a terminal silicon is a trimethyl group, r ranges from 1 to 20, p ranges from 10 to 1,000 and q ranges from 10 to 80).

The preferable examples of the compound represented by the chemical formula (2) include an epoxy-polyether-modified silicone synthesized in the hydrosilylation of a methyl hydrogen polysiloxane and compounds represented by the chemical formulae (7) and (12), which has a viscosity of 3,000 $mm^2/s$ at 25 deg.C. and an epoxy equivalent of 5,000 g/mol (and is a mixture of epoxy-polyether-modified silicones wherein a substituent for a terminal silicon is a trimethyl group, r ranges from 1 to 20, p ranges from 10 to 1,000, s ranges from 5 to 80 and t ranges from 5 to 80); and an epoxy-polyether-modified silicone synthesized in the hydrosilylation of a methyl hydrogen polysiloxane and compounds represented by the chemical formulae (9) and (12), which has a viscosity of 5,000 $mm^2/s$ at 25 deg.C. and an epoxy equivalent of 2,000 g/mol (and is a mixture of epoxy-polyether-modified silicones wherein a substituent for a terminal silicon is a trimethyl group, r ranges from 1 to 20, p ranges from 10 to 1,000, s ranges from 5 to 80 and t ranges from 5 to 80). The preferable examples also include X-22-4741, KF-1002 and X-22-3667 supplied by Shin-Etsu Chemical Co., Ltd. and FZ-3736, BY-16-876 and SF-8421 supplied by Dow Corning Toray Co., Ltd.

[Surfactant]

The precursor finish of the present invention contains a surfactant as an essential component. The surfactant is used as an emulsifier to emulsify or disperse the precursor finish, and improves the uniformity of the finish on fiber applied from emulsion or dispersion and the safety of working environment.

The surfactant is not specifically restricted, and is selected from nonionic, anionic, cationic and amphoteric surfactant known to those skilled in the art. One of or a combination of such surfactants may be used.

The nonionic surfactants include, for example, linear polyoxyalkylene alkylethers, such as polyoxyethylene hexyl ether, polyoxyethylene octyl ether, polyoxyethylene decyl ether, polyoxyethylene lauryl ether and polyoxyethylene cetyl ether; branched polyoxyalkylene primary alkyl ethers, such as polyoxyethylene 2-ethylhexyl ether, polyoxyethylene isocetyl ether and polyoxyethylene isostearyl ether; branched polyoxyalkylene secondary alkyl ethers, such as polyoxyethylene 1-hexylhexyl ether, polyoxyethylene 1-octylhexyl ether, polyoxyethylene 1-hexyloctyl ether, polyoxyethylene 1-pentylheptyl ether and polyoxyethylene 1-heptylpentyl ether; polyoxyalkylene alkenyl ethers, such as polyoxyethylene oleyl ether; polyoxyalkylene alkylphenyl ethers, such as polyoxyethylene octylphenyl ether, polyoxyethylene nonylphenyl ether, and polyoxyethylene dodecylphenyl ether; polyoxyalkylene alkylarylphenyl ethers, such as polyoxyethylene tristyrylphenyl ether, polyoxyethylene distyrylphenyl ether, polyoxyethylene styrylphenyl ether, polyoxyethylene tribenzyl phenyl, polyoxyethylene dibenzylphenyl ether, and polyoxyethylene benzylphenyl ether; polyoxyalkylene fatty acid esters, such as polyoxyethylene monolaurate, polyoxyethylene monooleate, polyoxyethylene monostearate, polyoxyethylene monomyristylate, polyoxyethylene dilaurate, polyoxyethylene dioleate, polyoxyethylene dimyristylate, and polyoxyethylene distearate; sorbitan esters, such as sorbitan monopalmitate and monooleate; polyoxyalkylene sorbitan fatty acid esters, such as polyoxyethylene sorbitan monostearate and polyoxyethylene sorbitan monooleate; glycerin fatty acid esters, such as glycerin monostearate, glycerin monolaurate and glycerin monopalmitate; polyoxyalkylene sorbitol fatty acid esters; sucrose fatty acid esters; polyoxyalkylene castor oil ethers, such as polyoxyethylene castor oil ether; polyoxyalkylene hydrogenated castor oil ethers, such as polyoxyethylene hydrogenated castor oil ether; polyoxyalkylene alkyl aminoethers, such as polyoxyethylene lauryl aminoether and polyoxyethylene stearyl aminoether; oxyethylene-oxypropylene block or random copolymers; terminally alkyletherified oxyethylene-oxypropylene block or random copolymers; and terminally sucrose-etherified oxyethylene-oxypropylene block or random copolymers.

Of those nonionic surfactants, branched polyoxyalkylene primary alkylethers, branched polyoxyalkylene secondary alkylethers, polyoxyalkylene alkenyl ethers, polyoxyalkylene alkylphenyl ethers, polyoxyalkylene fatty acid esters, oxyethylene-oxypropylene block copolymers and terminally alkyletherified oxyethylene-oxypropylene block copolymers are preferable for their excellent performance to emulsify silicone compounds. Furthermore, oxyethylene-oxypropylene block or random copolymers and terminally alkyletherified oxyethylene-oxypropylene block copolymers are more preferable for their performance to change into a tarry substance on fiber in baking process so as to protect fiber from damage.

The anionic surfactants include, for example, fatty acids and their salts, such as oleic acid, palmitic acid, sodium oleate, potassium palmitate and triethanolamine oleate; hydroxyl-containing carboxylic acids and their salts, such as hydroxyacetic acid, potassium hydroxyacetate, lactic acid and potassium lactate; polyoxyalkylene alkylether acetic acids and their salts, such as polyoxyalkylene tridecyl ether acetic acid and its sodium salt; salts of carboxyl-polysubstituted aromatic compounds, such as potassium trimellitate and potassium pyromellitate; alkylbenzene sulfonic acids and their salts, such as dodecylbenzene sulfonic acid and its sodium salt; polyoxyalkylene alkylether sulfonic acids and their salts, such as polyoxyethylene 2-ethylhexyl ether sulfonic acids and its potassium salt; higher fatty acid amide sulfonic acids and their salts, such as stearoyl methyltaurine and its sodium salt, lauroyl methyltaurine and its sodium salt, myristoyl methyltaurine N and its sodium salt and palmitoyl methyltaurine and its sodium salt; N-acyl sarcosine acids and their salts, such as lauroyl sarcosine acid and its sodium salt; alkyl phosphonic acids and their salts, such as octyl phosphonate and its potassium salt; aromatic phosphonic acids and their salts, such as phenyl phosphonate and its potassium salt; alkyl phosphonic acid alkyl phosphates and their salts, such as 2-ethylhexyl phosphonate mono-2-ethylhexyl ester and its potassium salt; nitrogen-containing alkyl phosphonic acids and their salts, such as aminoethyl phosphonic acid and its diethanol amine salt; alkyl sulfates and their salts, such as 2-ethylhexyl sulfate and its sodium salt; polyoxyalkylene sulfates and their salts, such as polyoxyethylene 2-ethylhexyl ether sulfate and its sodium salt; alkyl phosphates and their salts, such as lauryl phosphate and its potassium salt, cetyl phosphate and its potassium salt, and stearyl phosphate and its diethanol amine salt; polyoxyalkylene alkyl(alkenyl)ether phosphates and their salts, such as polyoxyethylene lauryl ether phosphate and its potassium salt, and polyoxyethylene oleyl ether phosphate and its triethanol amine salt; polyoxyalkylene alkylphenylether phosphates and their salts, such as polyoxyethylene nonylphenylether phosphate and its potassium salt, and polyoxyethylene dodecylphenyl ether phosphate and its potassium salt; long-chain sulfosuccinates, such as sodium di-2-ethylhexyl sulfosuccinate and sodium dioctyl sulfosuccinate; and long-chain N-acyl glutamates, such as sodiummonosodium N-lauroyl glutamate and disodium N-stearoyl-L-glutamate.

The cationic surfactants include, for example, quaternary ammonium salts, such as lauryltrimethyl ammonium chloride and oleylmethylethyl ammonium ethosulfate; and (polyoxyalkylene) alkylaminoether salts, such as (polyoxyethylene) lauryl aminoether lactate, stearyl aminoether lactate, and (polyoxyethylene) lauryl aminoether trimethyl phosphate.

The amphoteric surfactants include, for example, imidazoline surfactants, such as sodium 2-undecyl-N,N-(hydroxyethyl carboxymethyl)-2-imidazolinate and disodium 2-cocoyl-2-imidazolinium hydroxyde-1-carboxyethyloxiate; betaine surfactants, such as 2-heptadecyl-N-carboxymethyl-N-hydroxyethyl imidazolium betaine, lauryldimethyl aminoacetic acid betaine, alkyl betaine, amidobetaine and sulfobetaine; and amino-acid surfactants, such as N-lauryl glycine, N-lauryl-β-alanine and N-stearyl-β-alanine.

Of those surfactants mentioned above, ionic surfactants may change with time in the emulsion of a precursor finish and may influence on the cross-linking performance of silicones. Thus nonionic surfactants are preferable for a precursor finish owing to their stability through a storage period, minimum influence on silicone cross-linking performance and excellent performance to emulsify silicones.

[Amino-Modified Silicone]

The precursor finish of the present invention may further contain an amino-modified silicone. An amino-modified silicone greatly decreases wet fiber-to-fiber friction, and is highly effective to prevent the adhesion of single fibers, in other words, attaining uniform fiber drawing at the drawing step in a precursor fiber production process. The excellent lubrication effect by the amino-modified silicone, however, sometimes poses problems caused by insufficient fiber cohesion in precursor fiber production process and oxidative stabilization process, such as separation of single fiber, broken fiber and defect on fiber strands, all of which inhibit the production of high quality carbon fiber. The amino-modified silicone is advantageous for protecting precursor fiber in baking process because of its good cross-linking performance which accelerates crosslinking of silicone components in a finish on fiber to increase heat resistance of finish film in precursor baking process. The good cross-linking performance, however, sometimes poses a problem, i.e., gumming up of a precursor finish due to the accelerated cross-linking of silicone components even at fiber drying step after finish application in fiber production process. On the other hand, if a precursor finish is formulated with an amino-modified silicone containing extremely low amount of amino groups or formulated with a cross-linking inhibitor, such as a phosphate antioxidant or phosphate surfactant, in order to prevent the precursor finish from gumming up at finish application step, such finish sometimes forms poorly heat resistant finish film which is ineffective to prevent fiber fusing in baking process as the result of excessively inhibited silicone cross-linking, and inhibits the production of high-tenacity carbon fiber.

The epoxy-polyether-modified silicone attains higher wet fiber-to-fiber friction at high temperature and has less cross-linking performance than the amino-modified silicone. Thus a proper combination of the amino-modified silicone and epoxy-polyether-modified silicone meets various requirements including "preventing precursor adhesion in fiber production process", "sufficient precursor fiber cohesion in fiber production and oxidative stabilization processes", "preventing a precursor finish from gumming up at finish-application step in fiber production process", and "protecting fiber in baking process", and enables the production of high-tenacity carbon fiber. The combination has good compatibility to emulsifiers and improves "finish film uniformity" so as to facilitate the production of carbon fiber having higher tenacity.

The chemical structure of the amino-modified silicone is not specifically restricted, and the modifier amino group may be bonded to either a side chain or a terminal of the principal chain of silicone, or may be bonded to both of them. The amino group may either be a monoamine or polyamine, or may be an amino group containing both of the monoamine and polyamine.

The viscosity of the amino-modified silicone at 25 deg.C. is not specifically restricted, and should preferably range from 100 to 15,000 $mm^2/s$, more preferably from 500 to 10,000 $mm^2/s$, and further more preferably from 1,000 to 5,000 $mm^2/s$, for the purpose of preventing the adhesion of precursor fiber to improve the drawability of the precursor (in other words, minimizing friction between precursor fiber strands) at drawing step in fiber production process, preventing the amino-modified silicone from scattering off in oxidative stabilization process, and minimizing the finish gumming up at finish application step.

The amine equivalent of the amino-modified silicone is not specifically restricted, and should preferably range from 500 to 10,000 g/mol, more preferably from 1,000 to 5,000 g/mol, and further more preferably from 1,500 to 2,000 g/mol, for the purpose of minimizing the finish gumming up at finish application step and preventing the decrease in fiber fusing prevention performance of a finish in baking process including oxidative stabilization and carbonization processes.

[Precursor Finish]

The precursor finish of the present invention essentially comprises the epoxy-polyether-modified silicone mentioned above and a surfactant. The weight ratio of the epoxy-polyether-modified silicone in the total of the non-volatile components of the finish should range from 1 to 95 wt %, preferably from 30 to 95 wt %, more preferably from 50 to 95 wt %, further preferably from 70 to 90 wt %, and further more preferably from 75 to 85 wt %, for the uniformity of absolutely dried finish film, prevention of precursor fusing in baking process, and making well-balanced stable finish emulsion. A weight ratio of the epoxy-polyether-modified silicone below 1 wt % in the total of the non-volatile components often fails to attain the uniformity of absolutely dried finish film, that is one of the effects of the present invention. On the other hand, a weight ratio of the epoxy-polyether-modified silicone above 95 wt % inevitably decreases the ratio of other essential components to less than 5 wt %, and fails to prevent precursor fusing in baking process or to make stable finish emulsion. The non-volatile components of the precursor finish of the present invention means the absolutely dried ingredients remaining after heating the precursor finish at 105 deg.C. to remove the solvent and other volatile matter and attain constant weight.

The weight ratio of the surfactant in the total of the non-volatile components of the precursor finish of the present invention should range from 5 to 50 wt %, preferably from 10 to 40 wt %, more preferably from 10 to 30 wt %, and further more preferably from 15 to 25 wt %, for functioning as an emulsifier to make stable finish emulsion and maintaining sufficient heat resistance of the finish. A weight ratio of the surfactant below 5 wt % in the total of the non-volatile components fails to make stable finish emulsion, while a weight ratio above 50 wt % results in poor heat resistance of the finish and fails to prevent fiber fusing in baking process.

If the precursor finish of the present invention substantially contains only an epoxy-polyether-modified silicone as the silicone component, such precursor finish attains better precursor cohesion and fiber production efficiency while it attains high uniformity of absolutely dried finish film, prevents precursor fusing in baking process, forms stable emulsion and attains sufficiently high carbon fiber tenacity. A precursor finish substantially containing only an epoxy-polyether-modified silicone as the silicone component actually comprises an epoxy-polyether-modified silicone and surfactant in a total amount greater than 99.9 wt %, and preferably 100 wt % in the total of the non-volatile ingredients.

The precursor finish of the present invention may further comprise an amino-modified silicone as mentioned above. The total weight ratio of the epoxy-polyether-modified silicone and amino-modified silicone in the non-volatile components of the finish should range from 30 to 95 wt %, preferably from 50 to 95 wt %, more preferably from 70 to 90 wt %, and further more preferably from 75 to 85 wt %. The weight ratio between the epoxy-polyether-modified silicone and amino-modified silicone should preferably range from 5:95 to 90:10.

For more efficient utilization of the effect of both of the epoxy-polyether-modified silicone and amino-modified silicone, the weight ratio between the epoxy-polyether-modified silicone and amino-modified silicone should preferably range from 30:70 to 70:30, more preferably from 35:65 to 65:35, and further more preferably from 40:60 to 60:40.

Either of the epoxy-polyether-modified silicone and amino-modified silicone may be used in a greater weight ratio than the other according to the condition of a carbon fiber production process. For example, higher weight ratio of the epoxy-polyether-modified silicone is preferable for improving the cohesion of fiber bundles in precursor production and oxidative stabilization processes. For this purpose, the weight ratio between the epoxy-polyether-modified silicone and amino-modified silicone should preferably range from 50:50 to 90:10, more preferably from 70:30 to 90:10, and further more preferably from 80:20 to 85:15.

On the other hand, a greater weight ratio of the amino-modified silicone is preferable for preventing precursor adhesion in fiber production process or improving the effect to prevent precursor fusing in baking process. For this purpose, the weight ratio between the epoxy-polyether-modified silicone and amino-modified silicone should preferably range from 5:95 to 50:50, more preferably from 5:95 to 30:70, and further more preferably from 5:95 to 20:80.

A finish emulsion containing the amino-modified silicone may be prepared by mixing aqueous emulsions of the amino-modified silicone and the epoxy-polyether-modified silicone which have been separately prepared with different emulsifiers or with the same emulsifier prior to the mixing, or may be prepared by emulsifying a mixture of the amino-modified silicone and the epoxy-polyether-modified silicone with an emulsifier in an aqueous medium. The method for the emulsification is not specifically restricted.

The precursor finish of the present invention may further comprise silicones other than the epoxy-polyether-modified silicone and amino-modified silicone so far as those silicones do not inhibit the effect of the present invention. Specifically, those silicones are dimethyl silicones, epoxy-modified silicones, alkylene-oxide-modified silicones (polyether-modified silicones), carboxy-modified silicones, carbinol-modified silicones, alkyl-modified silicones, aminopolyether-modified silicones, amide-polyether-modified silicones, phenol-modified silicones, methacrylate-modified silicones, alkoxy-modified silicones, and fluorine-modified silicones. Of those silicones, amide-polyether-modified silicones are preferable for their compatibility with emulsifiers and their property to readily prevent the gumming up of a precursor finish and attain good heat resistance of the finish simultaneously.

The precursor finish of the present invention may further comprise components other than those mentioned above, i.e., antioxidants, such as phenolic, amine, sulfur, phosphorus or quinone compounds; antistats, such as sulfate salts of higher alcohol or higher alcoholic ethers, sulfonate salts, phosphate salts of higher alcohol or higher alcoholic ethers, cationic surfactants of quaternary ammonium salts, and cationic surfactants of amine salts; lubricants, such as alkyl esters of higher alcohol, ethers of higher alcohol, and waxes; antibacterial agents; antiseptics; anticorrosive agents; and hygroscopic agents; so far as those components do not inhibit the effect of the present invention.

The precursor finish may comprise only the non-volatile components mentioned above, though the finish should preferably contain a surfactant as an emulsifier and be formed into an aqueous emulsion in which the components are emulsified or dispersed in order to attain uniform finish application on precursor and secure the safety in working environment.

If the precursor finish of the present invention contains water, the weight ratios of water and the non-volatile components to the whole of the precursor finish are not specifically restricted, and should be determined according to the transportation cost of the precursor finish and handling property dependent on the viscosity of the precursor finish. The weight ratio of water in the whole of the precursor finish should preferably range from 0.1 to 99.9 wt %, more preferably from 10 to 99.5 wt %, and further more preferably from 50 to 99 wt %. The weight ratio of the non-volatile components in the whole of the precursor finish should preferably range from 0.01 to 99.9 wt %, more preferably from 0.5 to 90 wt %, and further more preferably from 1 to 50 wt %.

The precursor finish of the present invention is manufactured by mixing the components mentioned above. If the precursor finish is a composition prepared by emulsifying or dispersing the components in water, the method for emulsifying or dispersing the components mentioned above is not specifically restricted and any known methods are employable. Such methods include, for example, a method of dispersing and emulsifying the components of a precursor finish by adding each of them in warm water with agitation, or a method of mixing each of the components of a precursor finish and emulsifying the mixture through phase conversion where water is gradually added to the mixture being subjected to mechanical shear with a homogenizer, homogenizing mixer or ball mill.

Carbon fiber precursor and carbon fiber are produced with the precursor finish of the present invention. The production method for the precursor and carbon fiber with the precursor finish of the present invention is not specifically restricted, and may include, for example, the methods describer below.

[Production Method for Precursor and Carbon Fiber]

The carbon fiber production method of the present invention includes fiber production process, oxidative stabilization process and carbonization process. The carbon fiber precursor of the present invention is produced in the fiber production process.

The fiber production process includes the finish application step and drawing step where carbon fiber precursor is produced by applying an acrylic-fiber finish for carbon-fiber production (a precursor finish) to acrylic fiber which is the basic material of the acrylic fiber for carbon-fiber production (precursor).

At the finish application step, acrylic fiber which is the basic material of carbon fiber precursor is spun and applied with a precursor finish, in other words, a precursor finish is applied to as-spun acrylic fiber which is the basic material of carbon fiber precursor at the finish application step. The acrylic fiber which is the basic material of carbon fiber precursor is drawn soon after it is extruded, and further drawn with high draw ratio after finish application at the stage called "drawing step". The drawing operation may carried out in wet-heat drawing with hot steam or in dry-heat drawing with hot rollers.

The major component of the precursor is a polyacrylonitrile polymer produced by copolymerizing at least 95 mol % of acrylonitrile and 5 mol % or less of an oxidization promoter. A preferable oxidization promoter is a vinyl-containing compound which is copolymerizable with acrylonitrile. The fineness of a single precursor fiber is not specifically restricted, and should preferably range from 0.1 to 2.0 dtex for a good compromise between precursor performance and production cost. The number of single fiber constituting a precursor strand is not specifically restricted and preferably ranges from 1,000 to 96,000 for a good compromise between precursor performance and production cost.

The precursor finish may be applied to the acrylic fiber which is the basic material of carbon fiber precursor at any steps of the fiber production process, and should preferably be applied to acrylic fiber once before the drawing step. The precursor finish may be applied to acrylic fiber at any steps before the drawing step, for example, to acrylic fiber just after fiber extrusion. The precursor finish may also be re-applied to acrylic fiber at any steps after the drawing step, for example, to acrylic fiber just after drawing, at take-up step or just before oxidative stabilization process. For finish application, rollers may be employed for applying a precursor finish comprising non-volatile components alone, i.e., a neat finish, or bath immersion or a spray may be employed for applying a precursor finish being dispersed or emulsified in water or an organic solvent.

The amount of a precursor finish applied to precursor fiber should preferably range from 0.1 to 2 wt % of precursor weight, and more preferably from 0.3 to 5 wt %, for balancing the prevention of the adhesion or fusion of precursor fiber strands and prevention of the decrease of carbon fiber quality with the aide of coked precursor finish in carbonization process. An amount of a precursor finish on fiber smaller than 0.1 wt % may not sufficiently prevent adhesion and fusion of precursor fiber strands to result in decreased carbon fiber tenacity. On the other hand, an amount of a precursor finish on fiber greater than 2 wt % results in excessive coating on single fibers that may inhibit oxygen supply to precursor in oxidative stabilization process and decrease carbon fiber tenacity. The amount of a precursor finish on precursor mentioned here is defined to be the percentage of the weight of the non-volatile components in the precursor finish on the precursor to the weight of the precursor.

In the oxidative stabilization process, precursor applied with a precursor finish is converted into oxidized fiber at 200 to 300 deg.C. in an oxidative atmosphere, which is usually the air. The temperature of the oxidative atmosphere preferably ranges from 230 to 280 deg.C. In the oxidative stabilization process, acrylic fiber precursor applied with a precursor finish is heated for 20 to 100 minutes (preferably 30 to 60 minutes) being subjected to a tension given by drawing with a draw ratio ranging from 0.90 to 1.10 (preferably from 0.95 to 1.05). The oxidative stabilization process produces oxidized fiber having flame-retardant structure through intramolecular cyclization and the addition of oxygen to the cyclic structure.

In the carbonization process, the oxidized fiber is carbonized at 300 to 2,000 deg.C. in an inert atmosphere. At first, the oxidized fiber should be treated in a preliminary carbonization process (the first carbonization process), where the oxidized fiber is heated for several minutes being subjected to a tension given by a draw ratio ranging from 0.95 to 1.15 in an inert atmosphere of nitrogen or argon in a furnace with elevating temperature from 300 to 800 deg.C. Then, following to the first carbonization process, the oxidized fiber is treated in the second carbonization process to be further carbonized and graphitized, where the oxidized fiber after the first carbonization process is heated for several minutes being subjected to a tension given by a draw ratio ranging from 0.95 to 1.05 in an inert atmosphere of nitrogen or argon to be carbonized. The heating temperature in the second carbonization process should be controlled to be elevated to a highest temperature at least 1000 deg.C. (preferably in a range from 1000 to 2000 deg.C.). The highest temperature is selected according to the properties (tenacity, elastic modulus, etc.) required for a desirable carbon fiber.

The carbon fiber production method of the present invention may include graphitization process following to the carbonization process, when a carbon fiber of higher elastic modulus is desired. The graphitization is usually carried out by tensioning carbon fiber after carbonization process in an inert atmosphere of nitrogen or argon at a temperature ranging from 2000 to 3000 deg.C.

Carbon fiber produced in the method mentioned above may be subjected to a surface treatment for improving its adhesive strength to a matrix resin according to the end uses of the resultant composite material. Gas-phase or liquid-phase treatment may be employed for the surface treatment, and liquid-phase treatment with an acidic or alkaline electrolyte is preferable for better efficiency in composite production. Furthermore, various sizing agents having good compatibility to matrix resins may be applied to carbon fiber to improve the processability and handling property of carbon fiber.

EXAMPLES

The present invention is specifically described with the following examples, though the present invention is not restricted within the scope of those examples. The percent described in the following examples represents wt % (weight percent) except that otherwise defined. The properties were determined in the methods mentioned below.

[Amount of Finish on Fiber]

A finish-applied precursor was treated in alkaline fusion with potassium hydroxide and sodium butyrate, and dissolved in water. Then the pH of the resultant solution was controlled at 1 with hydrochloric acid. The solution was colored with sodium sulfite and ammonium molybdate to be subjected to colorimetric determination of silicic molybdenum blue which shows its peak at 815 nm wave length to determine the amount of silicon contained. Then the amount of the precursor finish on the precursor was calculated from the amount of silicon determined here and the amount of silicon in the precursor finish which was previously determined in the same manner.

[Uniformity of Absolutely Dried Finish Film]

Each of the emulsions of precursor finishes was weighed in an aluminum cup of 60 mm in diameter in an amount containing 1 g of non-volatile components. Then the emulsion was dried in an oven at 105 deg.C. for 3 hours to remove water and made into absolutely dried film. The film was visually inspected and evaluated with the following criteria.

◎: uniform finish film with no spots

○: finish film containing 1 to 5 spots

Δ: finish film containing 6 to 9 spots x: finish film containing 10 or more spots or finish film separating into two parts

[Precursor Adhesion Preventability]

A bundle of precursor after drawing was cut into 5 cm long, and the adhesion of single fibers was inspected and evaluated with the following criteria.

◎: no adhesion

○: almost no adhesion

Δ: a little adhesion x: a lot of adhesion

[Fiber Production Efficiency (Represented by Stain on Roller)]

The degree of stain (gumming up) on a drying roller after applying a finish to 50 kg of a precursor was evaluated with the following criteria.

◎: no stain from finish gumming up on roller to cause no problems in fiber production efficiency ○: a little stain from finish gumming up on roller to cause no problems in fiber production efficiency Δ: some stain from finish gumming up on roller to cause no problems in fiber production efficiency x: Stain from finish gumming up on roller to cause a little poor fiber production efficiency xx: a lot of stain from finish gumming up on roller to cause single fiber separation and fiber wrapping on rollers in fiber production

[Cohesion of Fiber Bundles]

The cohesion of precursor fiber bundles was visually inspected at winding and unwinding in fiber production process and at the inlet and outlet of an oxidation furnace in oxidative stabilization process, and evaluated with the following criteria.

◎: fiber bundles of uniform thickness with no separated single fibers

○: fiber bundles of uniform thickness with almost no separated single fibers

Δ: fiber bundles of uniform thickness with some separated single fibers x: fiber bundles containing a lot of separated single fibers and some broken fibers

[Fiber Fusing Preventability]

After carbonization process, twenty points on carbon fiber were randomly selected, and a 10-mm short fiber strand was cut out at each point. The fusing of each short fiber strand was checked and evaluated with the following criteria.

◎: no fusing

○: almost no fusing

Δ: a little fusing x: a lot of fusing

[Carbon Fiber Tenacity]

The tenacity of a carbon fiber was measured according to the testing method for epoxy-impregnated strand defined in JIS-R-7601, and the average of ten times of measurement was determined as the tenacity (GPa) of the carbon fiber tested.

[Description of Components]

Silicone composition S-E1: an epoxy-polyether-modified silicone (having a viscosity of 2,000 $mm^2/s$ at 25 deg.C., an epoxy equivalent of 3,000 g/mol, and a trimethyl group as the substituent bonded to its terminal silicon; and being a mixture of epoxy-polyether-modified silicones each containing a compound represented by the chemical formula (5) as the substituent for its side chain, wherein r ranges from 1 to 20, p ranges from 10 to 1,000, and q ranges from 10 to 80)

Silicone composition S-E2: an epoxy-polyether-modified silicone (having a viscosity of 4,000 $mm^2/s$ at 25 deg.C., an epoxy equivalent of 2,800 g/mol, and a trimethyl group as the substituent bonded to its terminal silicon; and being a mixture of epoxy-polyether-modified silicones each containing a compound represented by the chemical formula (6) as the substituent for its side chain, wherein r ranges from 1 to 20, p ranges from 10 to 1,000, and q ranges from 10 to 80)

Silicone composition S-E3: an epoxy-polyether-modified silicone (having a viscosity of 3,000 $mm^2/s$ at 25 deg.C., an epoxy equivalent of 5,000 g/mol, and a trimethyl group as the substituent bonded to its terminal silicon; and being a mixture of epoxy-polyether-modified silicones each containing compounds represented by the chemical formulae (7) and (12) as the substituent for its side chains, wherein r ranges from 1 to 20, p ranges from 10 to 1,000, s ranges from 5 to 80, and t ranges from 5 to 80)

Silicone composition S-E4: an epoxy-polyether-modified silicone (having a viscosity of 5,000 $mm^2/s$ at 25 deg.C., an epoxy equivalent of 2,000 g/mol, and a trimethyl group as the substituent bonded to its terminal silicon; and being a mixture of epoxy-polyether-modified silicones each containing a compound represented by the chemical formulae (9) and (12) as the substituent for its side chains, wherein r ranges from 1 to 20, p ranges from 10 to 1,000, s ranges from 5 to 80, and t ranges from 5 to 80)

Silicone composition S-E5: an epoxy-polyether-modified silicone (X-22-3667 supplied by Shin-Etsu Chemical Co., Ltd., having a viscosity of 4,900 $mm^2/s$ at 25 deg.C. and an epoxy equivalent of 4,500 g/mol)

Silicone composition S-E6: an epoxy-polyether-modified silicone (BY-16-876 supplied by Dow Corning Toray Co., Ltd., having a viscosity of 2,200 $mm^2/s$ at 25 deg.C. and an epoxy equivalent of 2,800 g/mol)

Silicone composition S-1: an amino-modified silicone (having a viscosity of 1,300 $mm^2/s$ at 25 deg.C. and an epoxy equivalent of 2,000 g/mol)

Silicone composition S-2: an amide-polyether-modified silicone (BY-16-878 supplied by Dow Corning Toray Co., Ltd., having a viscosity of 1,600 $mm^2/s$ at 25 deg.C. and an epoxy equivalent of 3,200 g/mol)

Silicone composition S-3: a polyether-modified silicone (having a viscosity of 2,900 $mm^2/s$ at 25 deg.C.)

Silicone composition S-4: an epoxy-modified silicone (having a viscosity of 8,000 $mm^2/s$ at 25 deg.C. and an epoxy equivalent of 3,200 g/mol, and being modified with a glycidyl epoxy group)

Silicone composition S-5: a dimethyl silicone (KF-96-100, supplied by Shin-Etsu Chemical Co., Ltd.)

Surfactant N-1: a polyoxyethylene alkylether, selected from those (with $C_{12}$-$C_{14}$ alkyl groups) having oxyethylene repeating units in a number ranging from 3 to 12 and having a hydrophilic-lipophilic balance proper for a silicone component in a finish Surfactant N-2: a mixture of an oxyethylene-oxypropylene block copolymer and a terminally alkyletherified compound thereof (with M.W. ranging from 1,000 to 5,000, where the ratio between oxypropylene and oxyethylene ranges from 80:20 to 60:40 and the ratio between those having terminal hydroxyl groups and those having terminal 2-ethylhexyl groups was selected to control the hydrophilic-lipophilic balance of the mixture proper for a silicone component in a finish.)

Example 1

The silicone composition S-E1 was emulsified with the surfactant N-1 to be made into aqueous precursor finish emulsion containing S-E1 and N-1 in the ratio of 90:10 as the non-volatile components. The concentration of the non-volatile components was 3.0 wt % of the emulsion. The finish emulsion was applied to an acrylic fiber, which is the raw material for carbon fiber precursor and consists of the copolymer of 97 mol % of acrylonitrile and 3 mol % of itaconic acid, to 1.0% of fiber weight. The acrylic fiber was then processed into carbon fiber precursor (of 24,000 filament count with monofilament fineness of 0.8 dtex) at steam drawing step with 2.1 draw ratio. The resultant precursor was oxidized in an oxidation furnace at 250 deg.C. for 60 minutes and subsequently baked in nitrogen atmosphere to be converted into carbon fiber in a carbonization furnace where the heating temperature was elevated from 300 to 1400 deg.C. The properties of the resultant carbon fiber are shown in Table 1.

Examples 2 to 35, Comparative Examples 1 to 8

Finish-applied precursors and carbon fibers were produced in the same manner as described in Example 1 except that finish emulsions were prepared to contain non-volatile components shown in Tables 1 to 5. The properties of the finish-applied precursors and the resultant carbon fibers are shown in Tables 1 to 5.

TABLE 1

| | Example | | | | | | | | |
|---|---|---|---|---|---|---|---|---|---|
| | 1 | 2 | 3 | 4 | 5 | 6 | 7 | 8 | 9 |
| Silicone S-E1 | 90 | 85 | — | — | — | — | — | — | — |
| Silicone S-E2 | — | — | 85 | — | — | — | — | — | — |
| Silicone S-E3 | — | — | — | 85 | — | — | — | — | — |
| Silicone S-E4 | — | — | — | — | 85 | — | — | — | — |
| Silicone S-E5 | — | — | — | — | — | 85 | 85 | — | 68 |
| Silicone S-E6 | — | — | — | — | — | — | — | 85 | — |
| Silicone S-1 | — | — | — | — | — | — | — | — | — |
| Silicone S-2 | — | — | — | — | — | — | — | — | 17 |
| Surfactant N-1 | 10 | 15 | 15 | 15 | 15 | 15 | — | — | 15 |
| Surfactant N-2 | — | — | — | — | — | — | 15 | 15 | — |
| Epoxy-polyether silicone:aminosilicone (weight ratio) | 100:0 | 100:0 | 100:0 | 100:0 | 100:0 | 100:0 | 100:0 | 100:0 | — |
| Silicones:surfactants (weight ratio) | 90:10 | 85:15 | 85:15 | 85:15 | 85:15 | 85:15 | 85:15 | 85:15 | 85:15 |
| Amount of finish on fiber (%) | 1.2 | 1.1 | 1.1 | 1.0 | 0.9 | 0.9 | 1.0 | 1.0 | 1.2 |
| Uniformity of dried finish film | ◎ | ◎ | ◎ | ◎ | ◎ | ◎ | ◎ | ◎ | ◎ |
| Precursor adhesion preventability | ○ | ○ | ○ | ○ | ○ | ○ | ○ | ○ | ○ |
| Fiber production efficiency | ◎ | ◎ | ◎ | ◎ | ◎ | ◎ | ◎ | ◎ | ◎ |
| Cohesion of fiber bundles | ◎ | ◎ | ◎ | ◎ | ◎ | ◎ | ◎ | ◎ | ◎ |
| Fiber fusing preventability | ○ | ○ | ○ | ○ | ○ | ○ | ○ | ○ | ◎ |
| Carbon fiber tenacity (GPa) | 6.85 | 6.80 | 6.85 | 6.80 | 6.80 | 6.85 | 6.95 | 6.95 | 7.10 |

TABLE 2

| | Example | | | | | | | | |
|---|---|---|---|---|---|---|---|---|---|
| | 10 | 11 | 12 | 13 | 14 | 15 | 16 | 17 | 18 |
| Silicone S-E1 | 68 | — | — | — | 51 | — | — | 42.5 | — |
| Silicone S-E2 | — | — | — | — | — | 51 | — | — | 42.5 |
| Silicone S-E3 | — | — | — | — | — | — | — | — | — |
| Silicone S-E4 | — | — | — | — | — | — | — | — | — |
| Silicone S-E5 | — | 68 | 59.5 | 59.5 | — | — | 51 | — | — |
| Silicone S-E6 | — | — | — | — | — | — | — | — | — |
| Silicone S-1 | 17 | 17 | 25.5 | 25.5 | 34 | 34 | 34 | 42.5 | 42.5 |
| Silicone S-2 | — | — | — | — | — | — | — | — | — |
| Surfactant N-1 | — | — | — | 15 | — | — | — | — | 15 |
| Surfactant N-2 | 15 | 15 | 15 | — | 15 | 15 | 15 | 15 | — |
| Epoxy-polyether silicone:aminosilicone (weight ratio) | 80:20 | 80:20 | 70:30 | 70:30 | 60:40 | 60:40 | 60:40 | 50:50 | 50:50 |
| Silicones:surfactants (weight ratio) | 85:15 | 85:15 | 85:15 | 85:15 | 85:15 | 85:15 | 85:15 | 85:15 | 85:15 |
| Amount of finish on fiber (%) | 0.9 | 1.0 | 1.0 | 1.2 | 1.2 | 1.1 | 1.1 | 1.2 | 0.9 |
| Uniformity of dried finish film | ◎ | ◎ | ◎ | ◎ | ◎ | ◎ | ◎ | ◎ | ◎ |
| Precursor adhesion preventability | ○ | ○ | ○ | ○ | ◎ | ◎ | ◎ | ◎ | ◎ |
| Fiber production efficiency | ◎ | ◎ | ◎ | ◎ | ◎ | ◎ | ◎ | ◎ | ◎ |
| Cohesion of fiber bundles | ◎ | ◎ | ◎ | ◎ | ◎ | ◎ | ◎ | ◎ | ◎ |
| Fiber fusing preventability | ○ | ○ | ○ | ○ | ○ | ○ | ○ | ◎ | ◎ |
| Carbon fiber tenacity (GPa) | 6.90 | 6.90 | 6.95 | 6.80 | 7.15 | 7.10 | 7.10 | 7.55 | 7.45 |

TABLE 3

| | Example | | | | | | | | |
|---|---|---|---|---|---|---|---|---|---|
| | 19 | 20 | 21 | 22 | 23 | 24 | 25 | 26 | 27 |
| Silicone S-E1 | — | — | — | 34 | — | 25.5 | 25.5 | — | — |
| Silicone S-E2 | — | — | — | — | — | — | — | — | — |
| Silicone S-E3 | — | — | — | — | — | — | — | 17 | 8.5 |
| Silicone S-E4 | 42.5 | — | — | — | — | — | — | — | — |
| Silicone S-E5 | — | 42.5 | 42.5 | — | 34 | — | — | — | — |
| Silicone S-E6 | — | — | — | — | — | — | — | — | — |
| Silicone S-1 | 42.5 | 42.5 | 42.5 | 51 | 51 | 59.5 | 59.5 | 68 | 76.5 |
| Silicone S-2 | — | — | — | — | — | — | — | — | — |
| Surfactant N-1 | — | — | 7 | — | — | 15 | — | 15 | 15 |
| Surfactant N-2 | 15 | 15 | 8 | 15 | 15 | — | 15 | — | — |
| Epoxy-polyether silicone:aminosilicone (weight ratio) | 50:50 | 50:50 | 50:50 | 40:60 | 40:60 | 30:70 | 30:70 | 20:80 | 10:90 |
| Silicones:surfactants (weight ratio) | 85:15 | 85:15 | 85:15 | 85:15 | 85:15 | 85:15 | 85:15 | 85:15 | 85:15 |
| Amount of finish on fiber (%) | 1.2 | 1.0 | 0.9 | 1.1 | 1.1 | 1.0 | 1.2 | 1.2 | 0.9 |
| Uniformity of dried finish film | ◎ | ◎ | ◎ | ○ | ○ | ○ | ○ | ○ | ○ |
| Precursor adhesion preventability | ◎ | ◎ | ◎ | ◎ | ◎ | ◎ | ◎ | ◎ | ◎ |
| Fiber production efficiency | ◎ | ◎ | ◎ | ○ | ○ | ○ | ○ | ○ | Δ |
| Cohesion of fiber bundles | ◎ | ◎ | ◎ | ○ | ○ | ○ | ○ | ○ | ○ |
| Fiber fusing preventability | ◎ | ◎ | ◎ | ◎ | ◎ | ◎ | ◎ | ◎ | ◎ |
| Carbon fiber tenacity (GPa) | 7.45 | 7.45 | 7.40 | 6.75 | 6.75 | 6.65 | 6.75 | 6.60 | 6.50 |

TABLE 4

| | Example | | | | | | | |
|---|---|---|---|---|---|---|---|---|
| | 28 | 29 | 30 | 31 | 32 | 33 | 34 | 35 |
| Silicone S-E1 | — | 45 | — | — | 32.5 | — | — | — |
| Silicone S-E2 | — | — | 37.5 | — | — | — | — | — |
| Silicone S-E3 | — | — | — | 30 | — | — | — | — |
| Silicone S-E4 | — | — | — | — | — | — | — | — |
| Silicone S-E5 | 45 | — | — | — | — | 32.5 | 72 | 76.5 |
| Silicone S-E6 | — | — | — | — | — | — | — | — |
| Silicone S-1 | 45 | 30 | 37.5 | 45 | 32.5 | 32.5 | 13 | 8.5 |
| Silicone S-2 | — | — | — | — | — | — | — | — |
| Surfactant N-1 | 5 | — | — | — | — | — | — | — |
| Surfactant N-2 | 5 | 25 | 25 | 25 | 35 | 35 | 15 | 15 |
| Epoxy-polyether silicone:aminosilicone (weight ratio) | 50:50 | 60:40 | 50:50 | 40:60 | 50:50 | 50:50 | 85:15 | 90:10 |
| Silicones:surfactants (weight ratio) | 90:10 | 75:25 | 75:25 | 75:25 | 65:35 | 63:35 | 85:15 | 85:15 |
| Amount of finish on fiber (%) | 0.9 | 1.0 | 1.0 | 1.1 | 1.2 | 1.1 | 1.0 | 1.1 |
| Uniformity of dried finish film | ◎ | ◎ | ◎ | ○ | ○ | ○ | ◎ | ◎ |
| Precursor adhesion preventability | ◎ | ◎ | ◎ | ◎ | ○ | ○ | ○ | ○ |
| Fiber production efficiency | ◎ | ◎ | ◎ | ○ | ◎ | ◎ | ◎ | ◎ |
| Cohesion of fiber bundles | ◎ | ◎ | ◎ | ◎ | ◎ | ◎ | ◎ | ◎ |
| Fiber fusing preventability | ◎ | ○ | ○ | ○ | ○ | ○ | ○ | ○ |
| Carbon fiber tenacity (GPa) | 7.60 | 7.00 | 7.05 | 6.25 | 6.15 | 6.10 | 6.90 | 6.95 |

TABLE 5

| | Comparative example | | | | | | | |
|---|---|---|---|---|---|---|---|---|
| | 1 | 2 | 3 | 4 | 5 | 6 | 7 | 8 |
| Silicone S-E1 | — | 2.9 | 97 | 40 | — | — | — | — |
| Silicone S-1 | 80 | 93.1 | — | — | 35 | — | 30 | 3 |
| Silicone S-3 | — | — | — | — | — | 35 | 20 | — |
| Silicone S-4 | — | — | — | — | 35 | 35 | 20 | — |
| Silicone S-5 | — | — | — | — | — | — | — | 57 |
| Surfactant N-1 | 20 | 4 | 3 | 60 | 30 | 30 | 30 | 40 |
| Epoxy-polyether silicone:aminosilicone (weight ratio) | 0:100 | 3:97 | 100:0 | 100:0 | — | — | — | — |
| Silicones:surfactants (weight ratio) | 80:20 | 96:4 | 97:3 | 40:60 | 70:30 | 70:30 | 70:30 | 60:40 |
| Amount of finish on fiber (%) | 0.9 | 0.9 | not emulsifiable and | 1.0 | 1.1 | 1.0 | 1.0 | 1.4 |
| Uniformity of dried finish film | X | X | could not be tested | ○ | X | Δ | Δ | X |
| Precursor adhesion preventability | ◎ | ◎ | | X | ◎ | Δ | Δ | X |
| Fiber production efficiency | XX | XX | | ○ | Δ | ○ | Δ | ○ |
| Cohesion of fiber bundles | X | X | | ◎ | ○ | ◎ | Δ | Δ |
| Fiber fusing preventability | ◎ | ◎ | | X | ○ | X | Δ | X |
| Carbon fiber tenacity (GPa) | 5.90 | 5.95 | | 5.00 | 5.75 | 5.50 | 5.65 | 5.65 |

As shown in Tables 1 to 5, the precursor finishes of the Examples exhibited better performance in each testing than the finishes of the Comparative examples, and contributed to the production of high-tenacity carbon fibers.

INDUSTRIAL APPLICABILITY

The acrylic-fiber finish for carbon-fiber production of the present invention is used for producing acrylic fiber for carbon-fiber production, and is effective to produce high-grade carbon fiber. The acrylic-fiber for carbon-fiber production of the present invention is applied with the acrylic-fiber finish for carbon-fiber production of the present invention, and is effective to produce high-grade carbon fiber. The carbon fiber production method of the present invention produces high-grade carbon fiber.

What is claimed is:

1. An acrylic-fiber finish for use in carbon-fiber production, the finish essentially comprising an epoxy-polyether-modified silicone;

an amino-modified silicone; and a surfactant, wherein the weight ratio of the epoxy-polyether-modified silicone ranges from 1 to 95 wt % and the weight ratio of the surfactant ranges from 5 to 50 wt % in the total of the nonvolatile components of the finish, wherein the total weight ratio of the epoxy-polyether-modified silicone and the amino-modified silicone ranges from 50 to 95 wt % in the total of the non-volatile components of the finish, and the weight ratio between the epoxy-polyether-modified silicone and the amino-modified silicone ranges from 5:95 to 90:10;

the epoxy-polyether-modified silicone is at least one compound selected from the group consisting of a compound represented by the chemical formula (1) shown below and a compound represented by the chemical formula (2) shown below, (1)

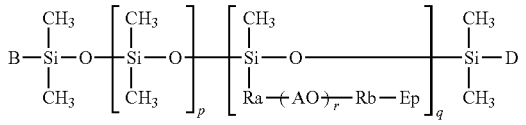

(2)

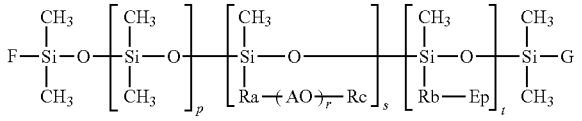

where each of the symbols in formulae (1) and (2) independently represents the meaning as follows:

Ep: an epoxy group represented by the chemical formula (3) or (4) shown below (3)

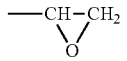

(4)

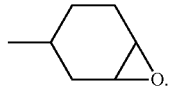

[Chemical formula 4]

A: a $C_2$-$C_4$ alkylene group, where each "A" of (AO)r may be the same or different Ra: a $C_1$-$C_6$ alkylene group Rb: a $C_1$-$C_6$ alkylene group or an alkoxyalkylene group represented by —$R^1OR^2$— (where $R^1$ and $R^2$ represent $C_1$-$C_6$ alkylene groups, which may be the same or different)

Rc: a hydrogen atom or a $C_1$-$C_{10}$ alkyl group r: an integer ranging from 1 to 50 p: an integer ranging from 1 to 10,000 q: an integer ranging from 1 to 100 s: an integer ranging from 1 to 100 t: an integer ranging from 1 to 100

B, D: a $C_1$-$C_3$ alkyl group, $C_1$-$C_3$ alkoxy group, hydroxyl group, or —Ra-(AO)r-Rb-Ep, where B and D may be the same or different F, G: a $C_1$-$C_3$ alkyl group, $C_1$-$C_3$ alkoxy group, hydroxyl group, —Rb-Ep, or —Ra-(AO)r-Rc, where F and G may be the same or different.

2. The acrylic-fiber finish for use in carbon-fiber production according to claim 1, wherein the epoxy group contained in the epoxy-polyether-modified silicone is a glycidyl epoxy group.

3. The acrylic-fiber finish for use in carbon-fiber production according to claim 1, wherein the weight ratio between the epoxy-polyether-modified silicone and the amino-modified silicone ranges from 5:95 to 50:50.

4. The acrylic-fiber finish for use in carbon-fiber production according to claim 1, which is dispersed in water to form an emulsion.

5. An acrylic-fiber finish for carbon-fiber production according to claim 1, wherein the total weight ratio of the epoxy-polyether-modified silicone and the amino-modified silicone ranges from 70 to 90 wt % in the total of the non-volatile components of the finish, and the weight ratio of the surfactant ranges from 10 to 30 wt % in the total of the nonvolatile components of the finish.

6. An acrylic-fiber finish for carbon-fiber production according to claim 1, wherein the amine equivalent of the amino-modified silicone ranges from 500 to 10,000 g/mol.

7. An acrylic-fiber for use in carbon-fiber production, which is produced by applying the acrylic-fiber finish for carbon-fiber production according to claim 1 to an acrylic fiber which is a basic material for the acrylic fiber for carbon-fiber production.

8. A method of producing carbon fiber comprising:

producing an acrylic fiber for carbon-fiber production by:

applying an acrylic-fiber finish to an acrylic fiber, the acrylic fiber being a base material for the acrylic fiber for carbon-fiber production;

converting the acrylic fiber, with the acrylic-fiber finish into oxidized fiber in an oxidative atmosphere at 200 to 300 deg.C.; and carbonizing the oxidized fiber in an inert atmosphere at 300 to 2,000 deg.C., the acrylic-fiber finish essentially comprising an epoxy-polyether-modified silicone and a surfactant, wherein the weight ratio of the epoxy-polyether-modified silicone ranges from 1 to 95 wt % and the weight ratio of the surfactant ranges from 5 to 50 wt % in the total of the nonvolatile components of the finish, the epoxy-polyether-modified silicone is at least one compound selected from the group consisting of a compound represented by the chemical formula (1) shown below and a compound represented by the chemical formula (2) shown below:

(1)

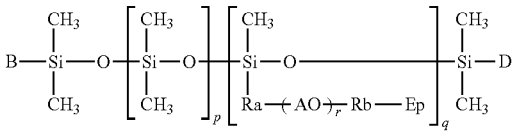

-continued (2)

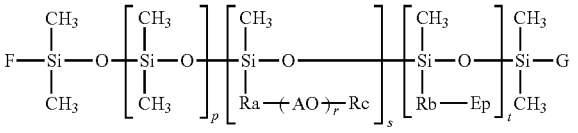

where each of the symbols in formulae (1) and (2) independently represents the meaning as follows:

Ep: an epoxy group represented by the chemical formula (3) or (4) shown below, (3)

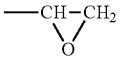

(4)

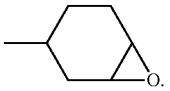

A: a $C_2$-$C_4$ alkylene group, where each "A" of (AO)r may be the same or different, Ra: a $C_1$-$C_6$ alkylene group, Rb: a $C_1$-$C_6$ alkylene group or an alkoxyalkylene group represented by —$R^1OR^2$— (where $R^1$ and $R^2$ represent $C_1$-$C_6$ alkylene groups, which may be the same or different), Rc: a hydrogen atom or a $C_1$-$C_{10}$ alkyl group, r: an integer ranging from 1 to 50, p: an integer ranging from 1 to 10,000, q: an integer ranging from 1 to 100, s: an integer ranging from 1 to 100, t: an integer ranging from 1 to 100, B, D: a $C_1$-$C_3$ alkyl group, $C_1$-$C_3$ alkoxy group, hydroxyl group, or —Ra-(AO)r-Rb-Ep, where B and D may be the same or different, F, G: a $C_1$-$C_3$ alkyl group, $C_1$-$C_3$ alkoxy group, hydroxyl group, —Rb-Ep, or —Ra-(AO)r-Rc, where F and G may be the same or different.

9. An acrylic-fiber finish for carbon-fiber production according to claim 8, wherein the epoxy group contained in the epoxy-polyether-modified silicone is a glycidyl epoxy group.

10. A method of producing carbon fiber according to claim 8, which further comprises an amino-modified silicone, wherein the total weight ratio of the epoxy-polyether-modified silicone and the amino-modified silicone ranges from 30 to 95 wt % in the total of the non-volatile components of the finish, and the weight ratio between the epoxy-polyether-modified silicone and the amino-modified silicone ranges from 5:95 to 90:10.

11. A method of producing carbon fiber according to claim 8, which is dispersed in water to form an emulsion.

12. A method of producing an acrylic fiber for carbon-fiber production comprising a fiber production process which includes applying the acrylic-fiber finish to an acrylic fiber, and a drawing step by drawing the obtained acrylic fiber, the acrylic-fiber finish for carbon-fiber production essentially comprising an epoxy-polyether-modified silicone and a surfactant, wherein the weight ratio of the epoxy-polyether-modified silicone ranges from 1 to 95 wt % and the weight ratio of the surfactant ranges from 5 to 50 wt % in the total of the nonvolatile components of the finish, the epoxy-polyether-modified silicone is at least one compound selected from the group consisting of a compound represented by the chemical formula (1) shown below and a compound represented by the chemical formula (2) shown below, (1)

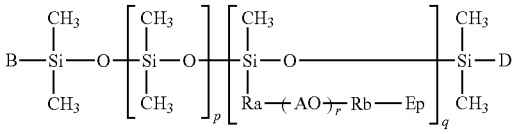

(2)

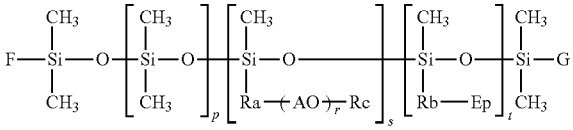

where each of the symbols in formulae (1) and (2) independently represents the meaning as follows:

Ep: an epoxy group represented by the chemical formula (3) or (4) shown below, (3)

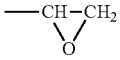

(4)

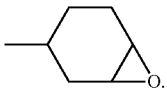

A: a $C_2$-$C_4$ alkylene group, where each "A" of (AO)r may be the same or different, Ra: a $C_1$-$C_6$ alkylene group, Rb: a $C_1$-$C_6$ alkylene group or an alkoxyalkylene group represented by —$R^1OR^2$— (where $R^1$ and $R^2$ represent $C_1$-$C_6$ alkylene groups, which may be the same or different), Rc: a hydrogen atom or a $C_1$-$C_{10}$ alkyl group, r: an integer ranging from 1 to 50, p: an integer ranging from 1 to 10,000, q: an integer ranging from 1 to 100, s: an integer ranging from 1 to 100, t: an integer ranging from 1 to 100, B, D: a $C_1$-$C_3$ alkyl group, $C_1$-$C_3$ alkoxy group, hydroxyl group, or —Ra-(AO)r-Rb-Ep, where B and D may be the same or different, F, G: a $C_1$-$C_3$ alkyl group, $C_1$-$C_3$ alkoxy group, hydroxyl group, —Rb-Ep, or —Ra-(AO)r-Rc, where F and G may be the same or different.

13. A method of producing an acrylic fiber for carbon-fiber production according to claim 12, wherein the epoxy group contained in the epoxy-polyether-modified silicone is a glycidyl epoxy group.

14. A method of producing an acrylic fiber for carbon-fiber production according to claim 12, which further comprises an amino-modified silicone, wherein the total weight ratio of the epoxy-polyether-modified silicone and the amino-modified silicone ranges from 30 to 95 wt % in the total of the non-volatile components of the finish, and the weight ratio between the epoxy-polyether-modified silicone and the amino-modified silicone ranges from 5:95 to 90:10.

15. A method of producing an acrylic fiber for carbon-fiber production according to claim 12, which is dispersed in water to form an emulsion.

* * * * *